US006766537B1

(12) United States Patent
Maki et al.

(10) Patent No.: US 6,766,537 B1
(45) Date of Patent: Jul. 27, 2004

(54) PROTECTIVE HELMET WITH DETACHABLE SHELL PIECE

(75) Inventors: Richard R. Maki, Roseau, MN (US); Joshua J. Leonard, Princeton, MN (US); Robert E. Mekash, Roseau, MN (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/329,997

(22) Filed: Dec. 26, 2002

(51) Int. Cl.[7] ..... A42C 5/04

(52) U.S. Cl. ..... 2/171.3; 2/411; 2/436; 128/200.28; 128/201.24; 128/201.25

(58) Field of Search ..... 2/171.3, 424, 411, 2/410, 425, 435, 436, 437, 909; 128/200.28, 201.22, 201.24, 201.25

(56) References Cited

U.S. PATENT DOCUMENTS

| | | | | |
|---|---|---|---|---|
| 3,223,086 A | * | 12/1965 | Denton | 128/201.24 |
| 3,496,854 A | * | 2/1970 | Hill et al. | 454/370 |
| 3,548,415 A | | 12/1970 | Waters | |
| 3,736,927 A | | 6/1973 | Misaqi | |
| 3,822,698 A | | 7/1974 | Guy | |
| 3,963,021 A | | 6/1976 | Bancroft | |
| 4,012,794 A | * | 3/1977 | Nomiyama | 2/411 |
| 4,095,289 A | * | 6/1978 | Kissen et al. | 128/201.24 |
| 4,136,688 A | | 1/1979 | Gorman | |
| 4,186,736 A | | 2/1980 | Angioletti et al. | |
| 4,227,520 A | | 10/1980 | Lord | |
| 4,280,491 A | | 7/1981 | Berg et al. | |
| 4,307,471 A | * | 12/1981 | Lovell | 2/411 |
| 4,433,988 A | | 2/1984 | Hinchliffe | |
| 4,462,399 A | | 7/1984 | Braun | |
| 4,498,202 A | | 2/1985 | Yamamoto | |
| 4,502,480 A | | 3/1985 | Yamamoto | |
| 4,519,099 A | | 5/1985 | Kamiya et al. | |
| 4,549,542 A | | 10/1985 | Chien | |
| 4,700,411 A | | 10/1987 | Kawasaki et al. | |
| 4,730,612 A | | 3/1988 | Dampney | |
| 4,734,939 A | | 4/1988 | Copp | |
| 4,852,562 A | | 8/1989 | Howie | |
| 4,860,389 A | | 8/1989 | Morin | |
| 4,890,335 A | | 1/1990 | Crowson | |
| 5,034,747 A | | 7/1991 | Donahue | |
| 5,104,430 A | | 4/1992 | Her-Mou | |
| 5,113,853 A | | 5/1992 | Dickey | |
| 5,125,402 A | | 6/1992 | Greenough | |
| 5,193,347 A | | 3/1993 | Apisdorf | |
| 5,245,994 A | | 9/1993 | Chang et al. | |
| 5,283,914 A | | 2/1994 | James | |
| 5,361,419 A | * | 11/1994 | Bernstein | 2/423 |
| 5,533,500 A | | 7/1996 | Her-Mou | |
| 5,577,495 A | | 11/1996 | Murphy | |
| 5,675,875 A | * | 10/1997 | Servatius | 24/704.1 |
| 5,745,923 A | | 5/1998 | Katz | |
| 5,806,102 A | | 9/1998 | Park | |
| 5,890,233 A | | 4/1999 | Kaffka | |
| 5,921,467 A | | 7/1999 | Larson | |
| 5,937,446 A | * | 8/1999 | Fallert | 2/412 |

(List continued on next page.)

FOREIGN PATENT DOCUMENTS

CH CH 671864 A5 * 10/1989

*Primary Examiner*—Rodney M. Lindsey
(74) *Attorney, Agent, or Firm*—Allen W. Groenke; Fredrikson & Byron, P.A.

(57) ABSTRACT

Protective helmet comprising a two piece shell, an electric motor and impeller useful for creating a positive pressure environment in the head space, and a filter for removing particulates and other substances. The impeller introduces atmospheric air into an air channel defined by two detachably attached shell pieces. The air is pushed through a particulate filter in the air channel and then through at least one aperture into the head space. A heating element may be used to heat the air flow.

52 Claims, 10 Drawing Sheets

U.S. PATENT DOCUMENTS 5,940,889 A * 8/1999 Shirai ..... 2/411
6,061,834 A * 5/2000 Liao ..... 2/171.3
6,081,929 A 7/2000 Rothrock et al.
6,247,186 B1 * 6/2001 Huang ..... 2/410
6,263,513 B1 7/2001 Murakami
6,272,692 B1 * 8/2001 Abraham ..... 2/411
6,418,564 B1 7/2002 Sheridan
6,425,143 B1 7/2002 Benedict et al.

* cited by examiner

PROTECTIVE HELMET WITH DETACHABLE SHELL PIECE

RELATED APPLICATIONS

The present application is related to a U.S. patent application entitled "Positive Pressure Protective Helmet" by the same inventor and filed on an even date herewith.

The present application is also related to a U.S. patent application entitled "Protective Helmet with Selectively Covered Aperture" by the same inventor and filed on an even date herewith.

The entire disclosures of the above mentioned applications are hereby incorporated by reference in their entirety.

FIELD OF THE INVENTION

The present invention relates generally to protective helmets. More particularly, the present invention relates to protective helmets for use when operating recreational vehicles.

BACKGROUND OF THE INVENTION

In the field of recreational vehicles (e.g., motorcycles, all terrain vehicles (ATVs), snowmobiles, sport trucks, dune buggies, sandrails, and the like) protective helmets are often worn to protect the user's head. Particulates such as sand and dust may enter the helmet during use and interfere with the user's ability to operate the vehicle. The more particulates a helmet keeps away from the user's face and eyes, the more comfortable the user will be. Even a few particulates in a user's eye may cause great discomfort.

Protective helmets are typically subjected to standardized performance tests to ensure the user is as safe as possible if a collision occurs. The Department of Transportation (DOT) and Snell are two major organizations that set safety standards for crash-helmets in the United States. DOT sets minimum standards for all helmets designed for motorcyclists and other motor vehicle users. The standard is Federal Motor Vehicle Safety Standard 218 and is codified at 49 C.F.R. §571.218. The Snell 2000 Standard for Protective Headgear establishes performance characteristics for helmets for use in open motorized vehicles such as motorcycles, ATVs, and snowmobiles.

The DOT subjects crash-helmets to an impact attenuation test. Impact attenuation is determined by measuring the acceleration experienced by a helmeted test headform during a collision. The helmeted headform is dropped on both a hemispherical and flat steel anvil. The height for the helmet and test headform combination fall onto the hemispherical anvil is set so that the impact speed is 5.2 m/sec. The minimum drop height is 138.4 cm. The guided freefall drop height for the helmet and test headform combination unto the flat anvil is set so that the minimum impact speed is 6.0 m/sec, with a minimum drop height of 182.9 cm.

When an impact attenuation test is conducted as described above, the following criteria are used to determine if a helmet passes; the test headform must not experience a peak acceleration over 400 G, accelerations in excess of 200 G must not exceed a cumulative duration of 2.0 milliseconds, and accelerations over 150 G must not exceed a cumulative duration of 4.0 milliseconds. The Snell impact management test involves a series of controlled impacts. First, the helmet is positioned on a head test platform. The helmeted headform is then dropped in guided falls onto test anvils. The impact energy must be a minimum of 150 Joules. If the peak acceleration imparted to the headform exceeds 300 G, the helmet fails.

SUMMARY OF THE INVENTION

The present invention relates generally to protective helmets. More particularly, the present invention relates to protective helmets for use when operating recreational vehicles (e.g., motorcycles, all terrain vehicles (ATVs), snowmobiles, sport trucks, dune buggies, sandrails, and the like). A protective helmet in accordance with an exemplary embodiment of the present invention comprises a first shell piece defining a head space and a second shell piece detachably attached to the first shell piece at an interface.

In accordance with one feature of the present invention, the interface has a pre-selected separation force. In some advantageous implementations, the pre-selected separation force of the interface is selected so that the second shell piece separates from the first shell piece when a pre-selected force is applied across the interface. In certain implementations, the pre-selected force less than a force required to dislodge a vehicle rider from a vehicle. Some embodiments of the present invention also feature a water tight seal formed between the first shell piece and the second shell piece.

In some embodiments of the present invention, the interface comprises a plurality of fasteners. Examples of fasteners which may be suitable in some applications include hook and loop fasteners, snaps, threaded fasteners, and pins. In certain embodiments, each fasteners comprises a shaft. This shaft may be advantageously adapted to break when a pre-selected breaking force is applied thereto. In some embodiments, the pre-selected breaking force is an axial force. In other embodiments, the pre-selected breaking force is a shear force. In some case, a diameter of the shaft may be dimensioned so that the shaft breaks when the pre-selected breaking force is applied to the shaft.

The first shell piece and the second shell piece may define a channel in some embodiments. When this is the case, a blower may be advantageously arranged for urging air into the channel. For example, the blower may draw air from the atmosphere outside the helmet and forcing the air into the air channel defined by the first shell piece and the second shell piece.

The second shell piece is defines the top portion of a channel while the second shell piece is detachably attached to the first shell piece. In an exemplary implementation, the second shell piece comprises a first edge flange and a second edge flange. The flanges preferably contact the first edge and second edge of the first shell piece to help detachably attach the first shell piece and the second shell piece. The second shell piece also comprises an intermediate portion which has a curved shape in lateral cross-section and which extends between the first edge flange and the second edge flange. In some advantageous implementations of the present invention, the first shell piece has sufficient strength to pass the DOT and Snell impact management tests whether or not the second shell piece is detachably attached. This may be accomplished by providing a wall of first shell piece having a desired combination of material strength and wall thickness.

DETAILED DESCRIPTION OF THE INVENTION

Figure 1:
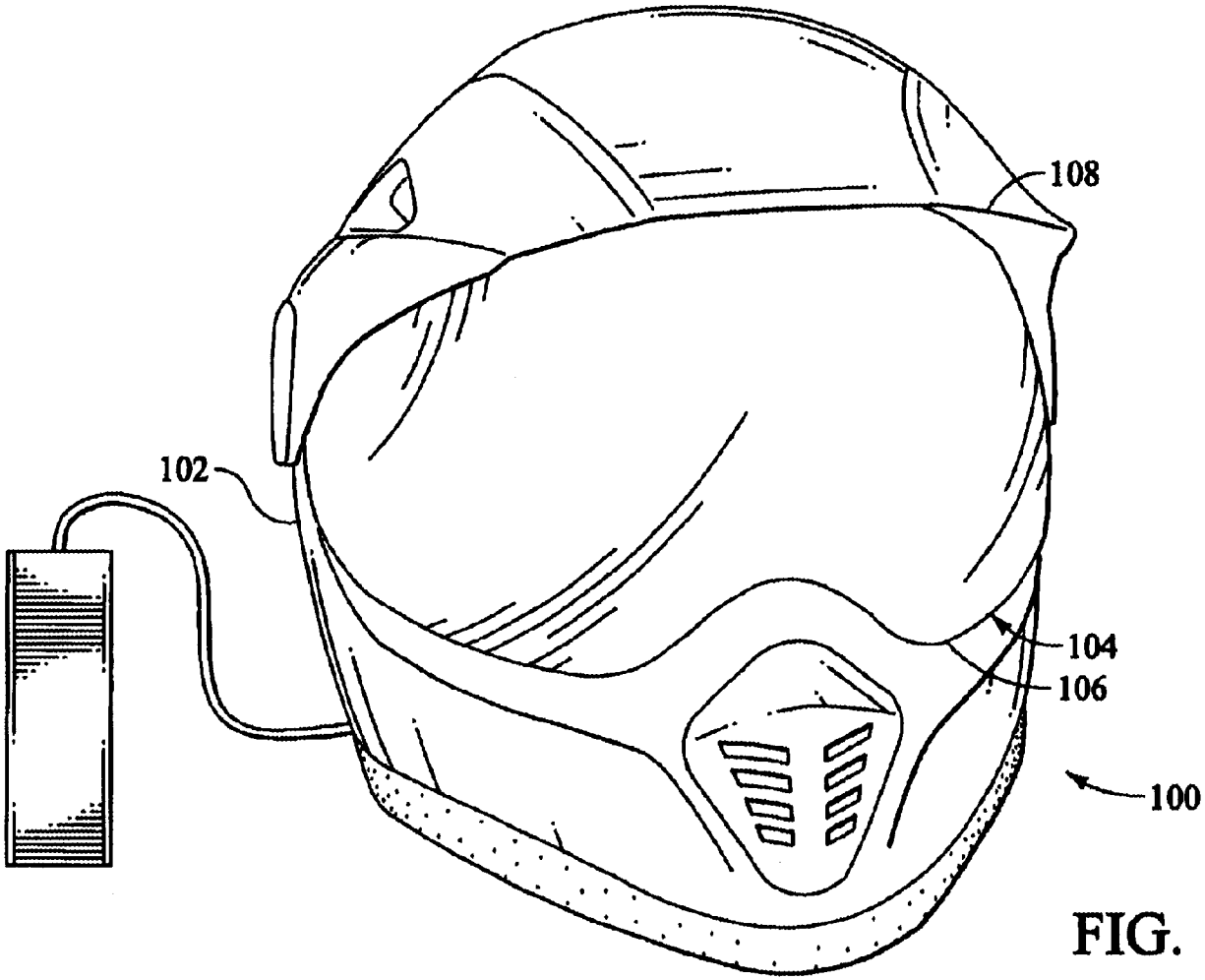
FIG. 1 is a perspective view of a helmet in accordance with an exemplary embodiment of the present invention.

The following detailed description should be read with reference to the drawings, in which like elements in different drawings are numbered identically. The drawings, which are not necessarily to scale, depict selected embodiments and are not intended to limit the scope of the invention. Accordingly, it is to be understood that the invention is not limited in its application to the details of construction and the arrangements of components set forth in the following description or illustrated in the drawings.

FIG. 1 is a perspective view of a helmet 100 in accordance with an exemplary embodiment of the present invention. Helmet 100 comprises a first shell piece 102 defining a front opening 104. First shell piece 102 may advantageously include an inner shell comprising an energy absorbing material and an outer shell. The inner shell of first shell piece 102 may define a head space. In the embodiment of FIG. 1, a shield 106 is disposed over front opening 104. Also in the embodiment of FIG. 1, helmet 100 includes a visor 108. Visor 108 and shield 106 are preferably detachably attached to first shell piece 102 of helmet 100.

Figure 2:
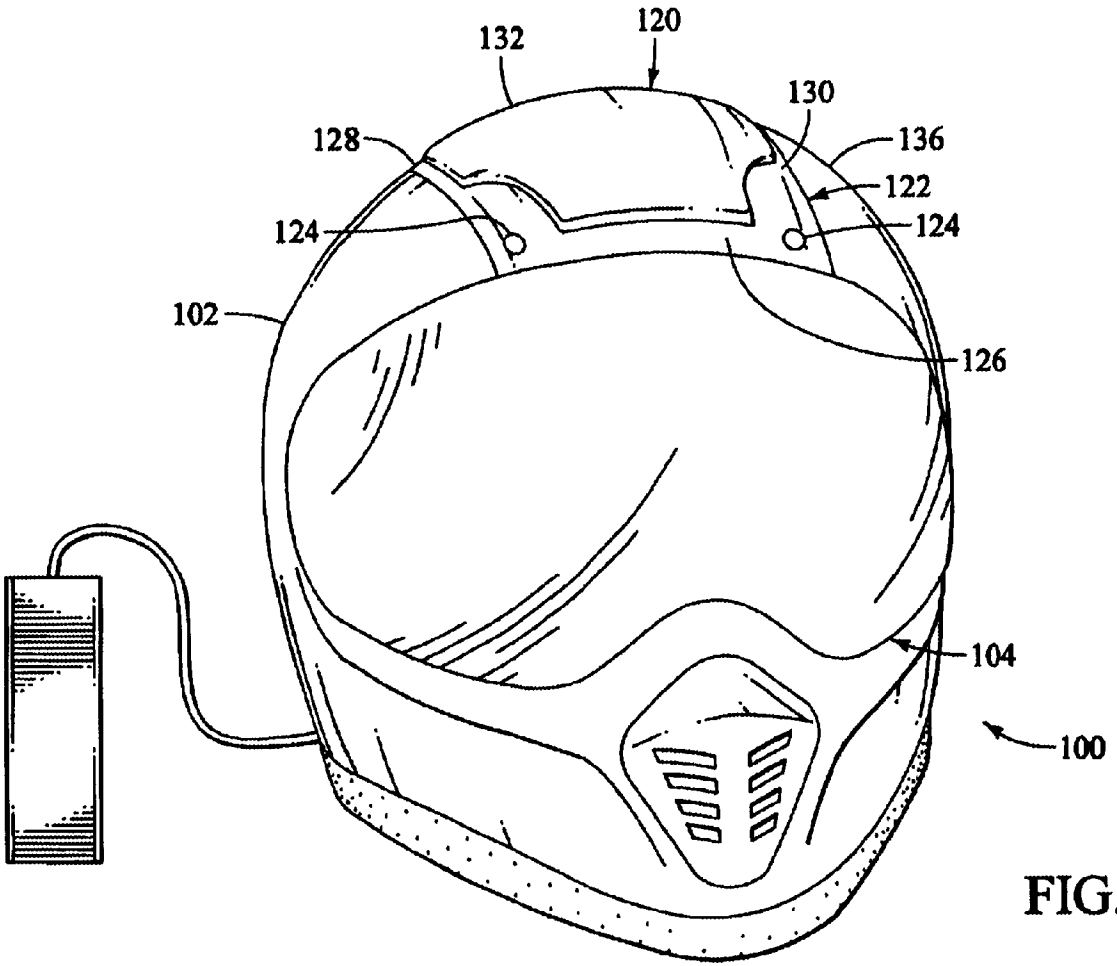
FIG. 2 is an additional perspective view of helmet shown in the previous figure.

FIG. 2 is an additional perspective view of helmet 100 shown in the previous figure. In the embodiment of FIG. 2, visor 108 has been detached from first shell piece 102. In FIG. 2 it may be appreciated that helmet 100 includes a second shell piece 120. In some advantageous embodiments of the present invention, second shell piece 120 is detachably coupled to first shell piece 102 at an interface 122. In the embodiment of FIG. 2, interface 122 comprises a plurality of fasteners 124. Various types of fasteners may be utilized without deviating from the spirit and scope of the present invention. Examples of fasteners that may be suitable in some applications include hook and loop fasteners, snaps, pins, rivets, screws, and adhesives.

In FIG. 2, it may be appreciated that second shell piece 120 comprises a front flange 126, a first edge flange 128, and a second edge flange 130. An intermediate portion 132 of second shell piece 120 is shown extending between first edge flange 128 and second edge flange 130. In some embodiments of the present invention, intermediate portion 132 of second shell piece 120 has a curved shape in lateral cross-section. In the embodiment of FIG. 2, an outer surface of each flange is substantially flush with an outer surface 136 of first shell piece 102.

Figure 3:
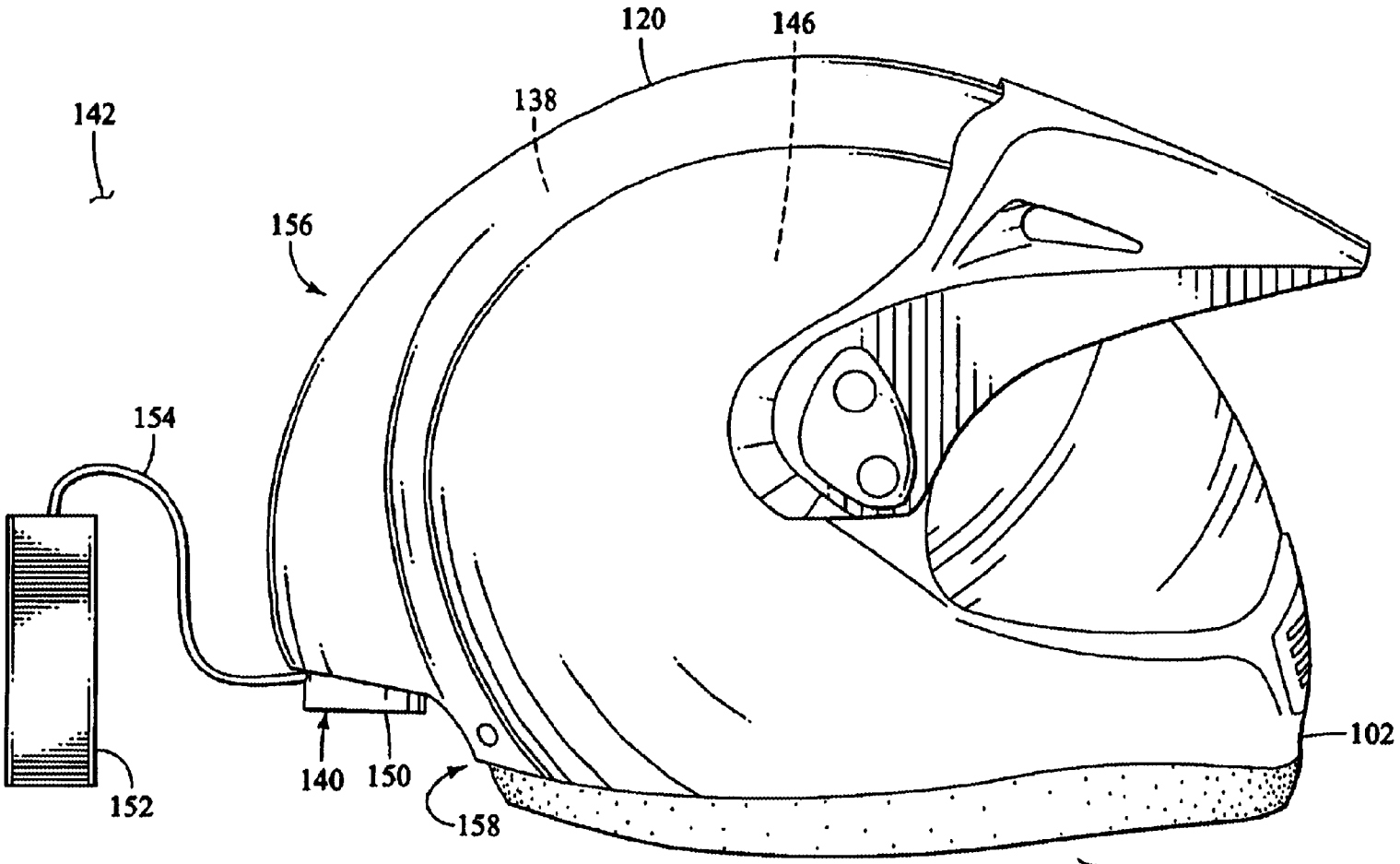
FIG. 3 is a plan view of a helmet in accordance with an exemplary embodiment of the present invention.

FIG. 3 is a plan view of a helmet 100 in accordance with an exemplary embodiment of the present invention. Helmet 100 comprises a first shell piece 102 and a second shell piece 120. In the embodiment of FIG. 3, first shell piece 102 and second shell piece 120 define an air flow channel 138.

In FIG. 3 a portion of a blower 140 can be seen extending beyond second shell piece 120. In an advantageous embodiment of the present invention, blower 140 is adapted draw air from the atmosphere 142 surrounding helmet 100. This air may be blown through flow channel 138 and may enter a head space 146 of helmet 100 via one or more apertures defined by first shell piece 102. In some advantageous embodiments of the present invention, blower 140 is capable of producing an air flow through flow channel 138 that is sufficient to provide a positive pressure inside head space 146. In these advantageous embodiments, the positive pressure inside head space 146 is preferably greater than an ambient pressure found in atmosphere 142 outside of first shell piece 102.

In the embodiment of FIG. 3, blower 140 comprises a motor 150 which may be used to turn an impeller. In the embodiment of FIG. 3, a battery pack 152 is coupled to motor 150 of blower 140 via a cable 154. Battery pack 152 may be worn, for example, clipped to the belt of a rider. In the embodiment of FIG. 3, blower 140 is disposed proximate a back side 156 of first shell piece 102. In FIG. 3, it may be appreciated that blower 140 is disposed proximate a bottom extent 158 of first shell piece 102.

Figure 4:
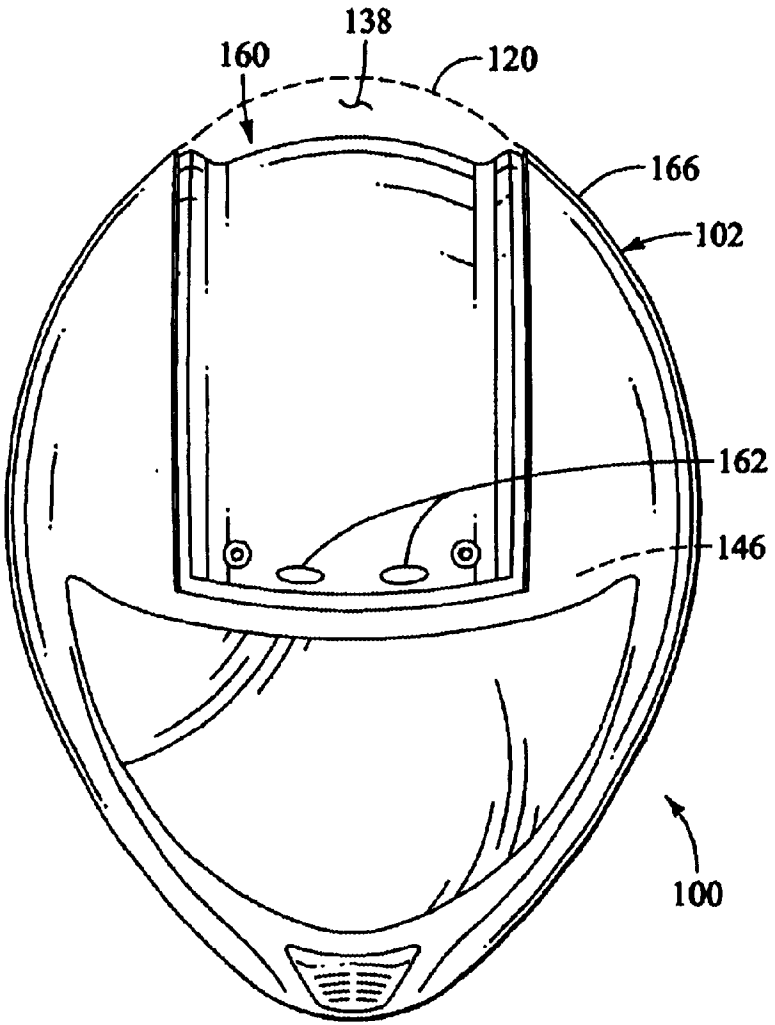
FIG. 4 is an additional plan view of helmet shown in the previous figure.

FIG. 4 is an additional plan view of helmet 100 shown in the previous figure. In the embodiment of FIG. 4, second shell piece 120 has been separated from first shell piece 102. The previous position of second shell piece 120 is illustrated with a dashed line in FIG. 4. Thus, in FIG. 4 it may be appreciated that second shell piece 120 and first shell piece 102 cooperate to define flow channel 138.

In FIG. 4 it may be appreciated that first shell piece 102 defines a trough 160. An outer shell 166 of first shell piece 102 defines a plurality of apertures 162 that fluidly communicate with flow channel 138. In some advantageous embodiments of the present invention, apertures 162 are dimensioned such that they will not allow objects having a particular size to pass into head space 146 defined by first shell piece 102. In some embodiments, for example, the maximum span of each aperture 162 is less than about 13.0 millimeters.

Figure 5:
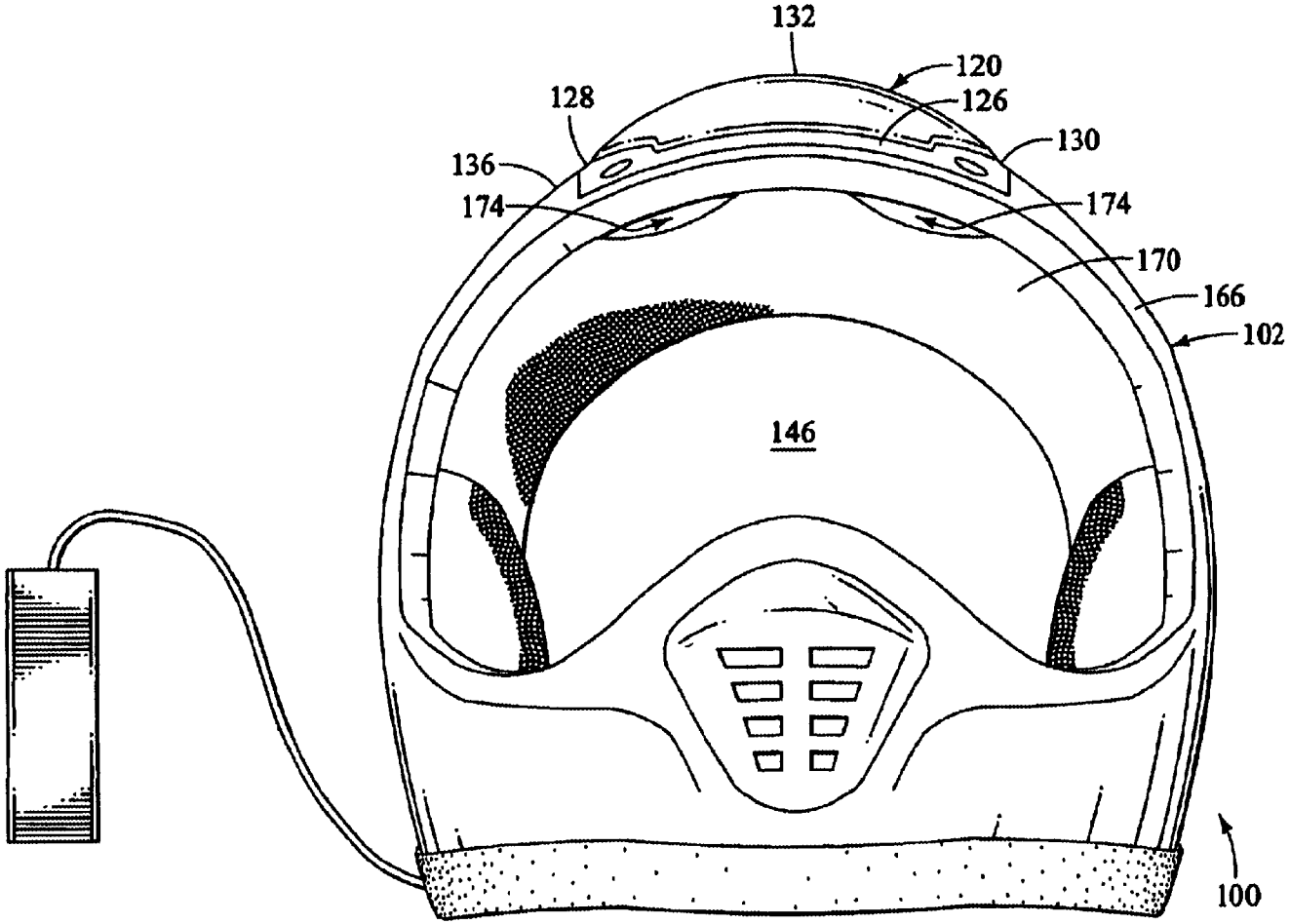
FIG. 5 is an additional plan view of helmet shown in the previous figure.

FIG. 5 is an additional plan view of helmet 100 shown in the previous figure. An inner shell 170 of first shell piece 102 is visible in FIG. 5. In some advantageous embodiments of the present invention inner shell 170 comprises an energy absorbing material. In the embodiment of FIG. 5, inner shell 170 of first shell piece 102 defines a head space 146. In FIG. 5 it may be appreciated that inner shell 170 of first shell piece 102 defines a plurality of lumens 174. Each lumen 174 preferably communicates with an aperture defined by an outer shell 166 of first shell piece 102.

In FIG. 5 it may be appreciated that second shell piece 120 comprises a front flange 126, a first edge flange 128 and a second edge flange 130. An intermediate portion 132 of second shell piece 120 is shown extending between first edge flange 128 and second edge flange 130. In some embodiments of the present invention, intermediate portion 132 of second shell piece 120 has a curved shape in lateral cross-section. In the embodiment of FIG. 5, second shell piece 120 also includes a front flange 126. In FIG. 5, it may be appreciated that an outer surface of each flange is substantially flush with an outer surface 136 of first shell piece 102.

Figure 6:
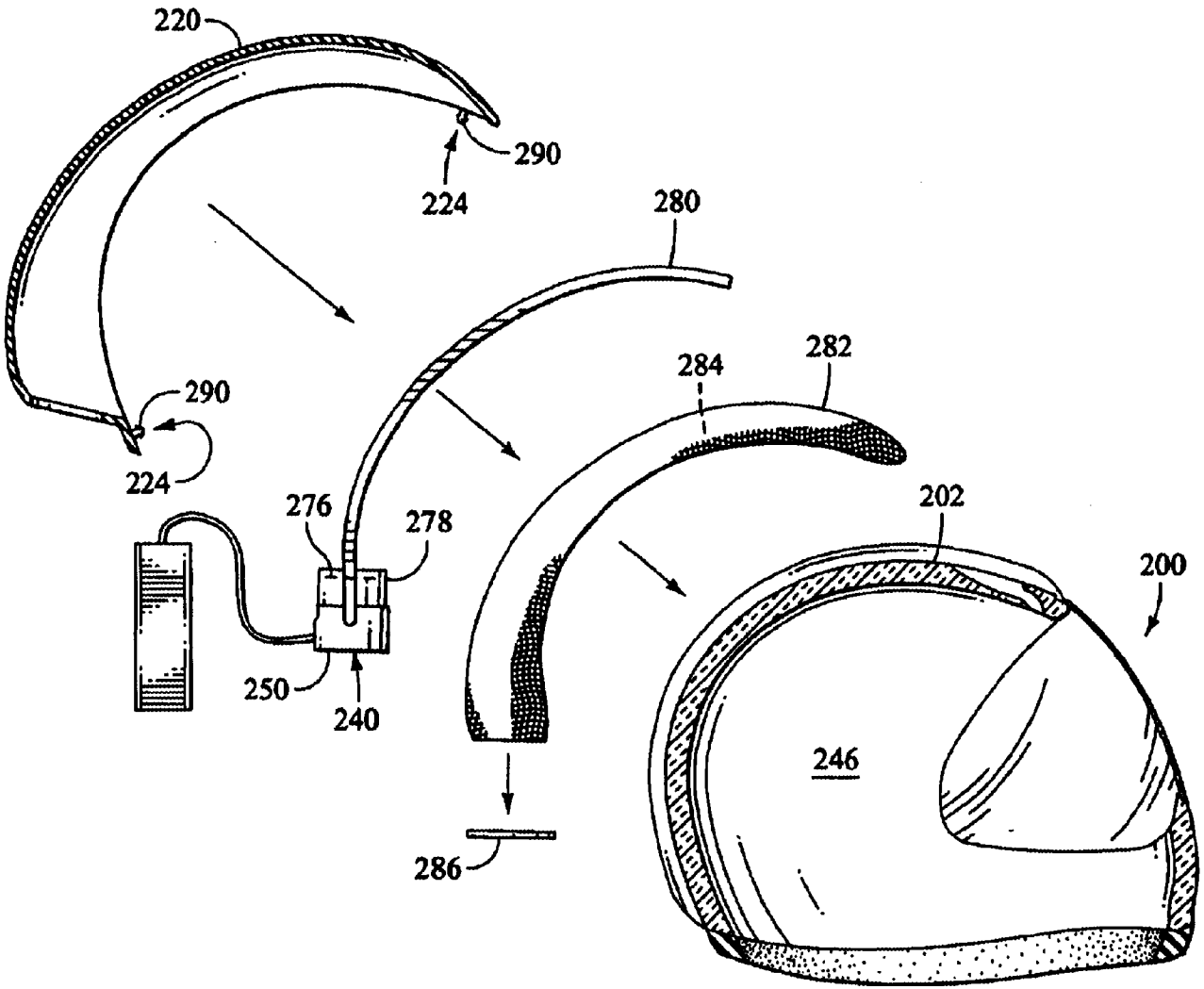
FIG. 6 is an exploded assembly view of a helmet in accordance with an exemplary embodiment of the present invention.

FIG. 6 is an exploded assembly view of a helmet 200 in accordance with an exemplary embodiment of the present invention. Helmet 200 of FIG. 6 includes a blower 240. In the embodiment of FIG. 6, blower 240 comprises a motor 250 for turning an impeller 276. In the embodiment of FIG. 6, impeller 276 is disposed within a shroud 278. Also in the embodiment of FIG. 6, a filter frame 280 is coupled to blower 240.

Helmet 200 also includes a filter sock 282 defining a cavity 284 that is preferably dimensioned to receive filter frame 280. A proximal end of filter sock 282 may be fixed around the circumference of blower 240 using an elastic ring 286. Blower 240 may be advantageously utilized to create an air stream flowing through filter sock 282. Filtered air may then enter a head space 246 defined by a first shell piece 202 of helmet 200. A second shell piece 220 may be selectively coupled to first shell piece 202 utilizing a plurality of fasteners 224. In the embodiment of FIG. 6, each fastener 224 has a shaft 290.

Figure 7:
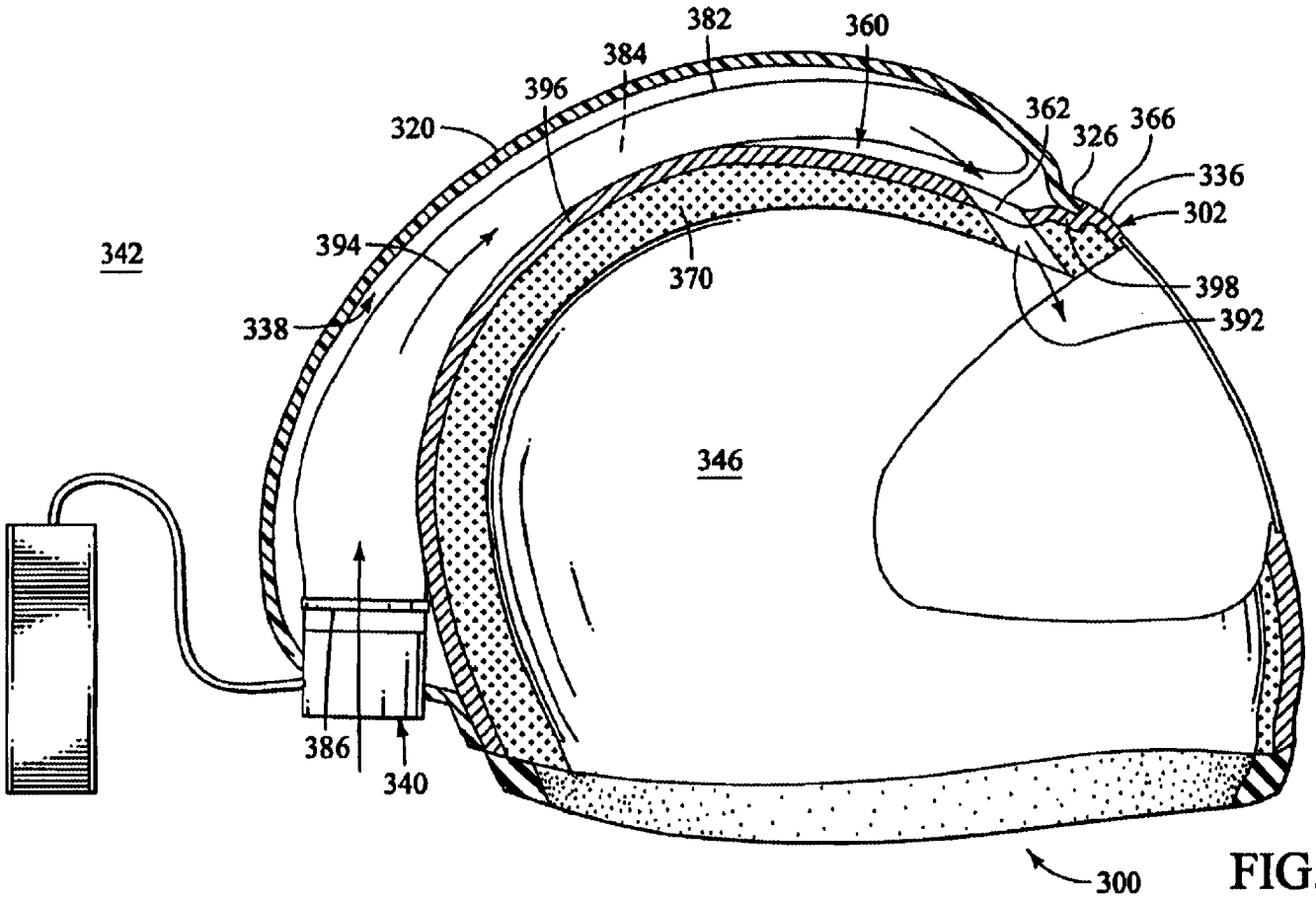
FIG. 7 is a cross sectional view of a helmet in accordance with the present invention.

FIG. 7 is a cross sectional view of a helmet 300 in accordance with the present invention. In the embodiment of FIG. 7, a filter sock 382 is disposed within a flow channel 338 defined by a first shell piece 302 and a second shell piece 320. In FIG. 7, it may be appreciated that an outer shell 366 of first shell piece 302 defines an aperture 362 that provides fluid communication between flow channel 338 and a head space 346 defined by an inner shell 370 of first shell piece 302. Inner shell 370 defines a lumen 392 in the embodiment of FIG. 7.

In some advantageous implementations, flow channel 338 is shaped to provide smooth airflow with relatively low back pressure. In the embodiment of FIG. 7, the lateral cross sectional area of flow channel 338 gradually decreases along an air path extending from blower 340 to aperture 362. Also in the embodiment of FIG. 7, flow channel 338 has a radius of curvature similar to a dimension of a human head.

A filter sock 382 defining a cavity 384 is shown disposed within flow channel 338. A proximal end of filter sock 382 is shown fixed around the circumference of blower 340 by elastic ring 386. In FIG. 7 an air stream 394 is shown passing through filter sock 382. Blower 340 may be advantageously utilized to draw air from an atmosphere 342 surrounding helmet 300 and push this air through filter sock 382. Filtered air may then enter a head space 346 defined by a first shell piece 302.

In some advantageous embodiments of the present invention inner shell 370 of first shell piece 302 comprises an energy absorbing material. In the embodiment of figure 7, inner shell 370 defines a head space 346. In FIG. 7 it may be appreciated that inner shell 370 defines a lumen 392 that fluidly communicates with aperture 362.

In FIG. 7, it may be appreciated that second shell piece substantially covers aperture 362 while second shell piece 320 is attached to first shell piece 302. In certain advantageous embodiments, first shell piece 302 has sufficient strength to pass the DOT and Snell impact management tests whether or not the second shell piece 320 is detachably attached. This may be accomplished by providing a wall 396 of first shell piece 302 having a desired combination of material strength and wall thickness.

In the embodiment of FIG. 7, first shell piece 302 defines a trough 360 that is dimensioned to receive second shell piece 320. Also in the embodiment of FIG. 7, second shell piece 320 includes a front flange 326. Trough 360 of first shell piece 302 includes a shoulder 398 that is dimensioned such that front flange 326 of second shell piece 320 rests on shoulder 398 of trough 360 while second shell piece 320 is attached to first shell piece 302.

In FIG. 7, it may be appreciated that shoulder 398 of trough 360 is located at a depth corresponding to a thickness of front flange 326 of second shell piece 320. Accordingly, an outer surface of front flange 326 is substantially flush with an outer surface 336 of the first shell piece 302 in the embodiment of FIG. 7.

Figure 8:
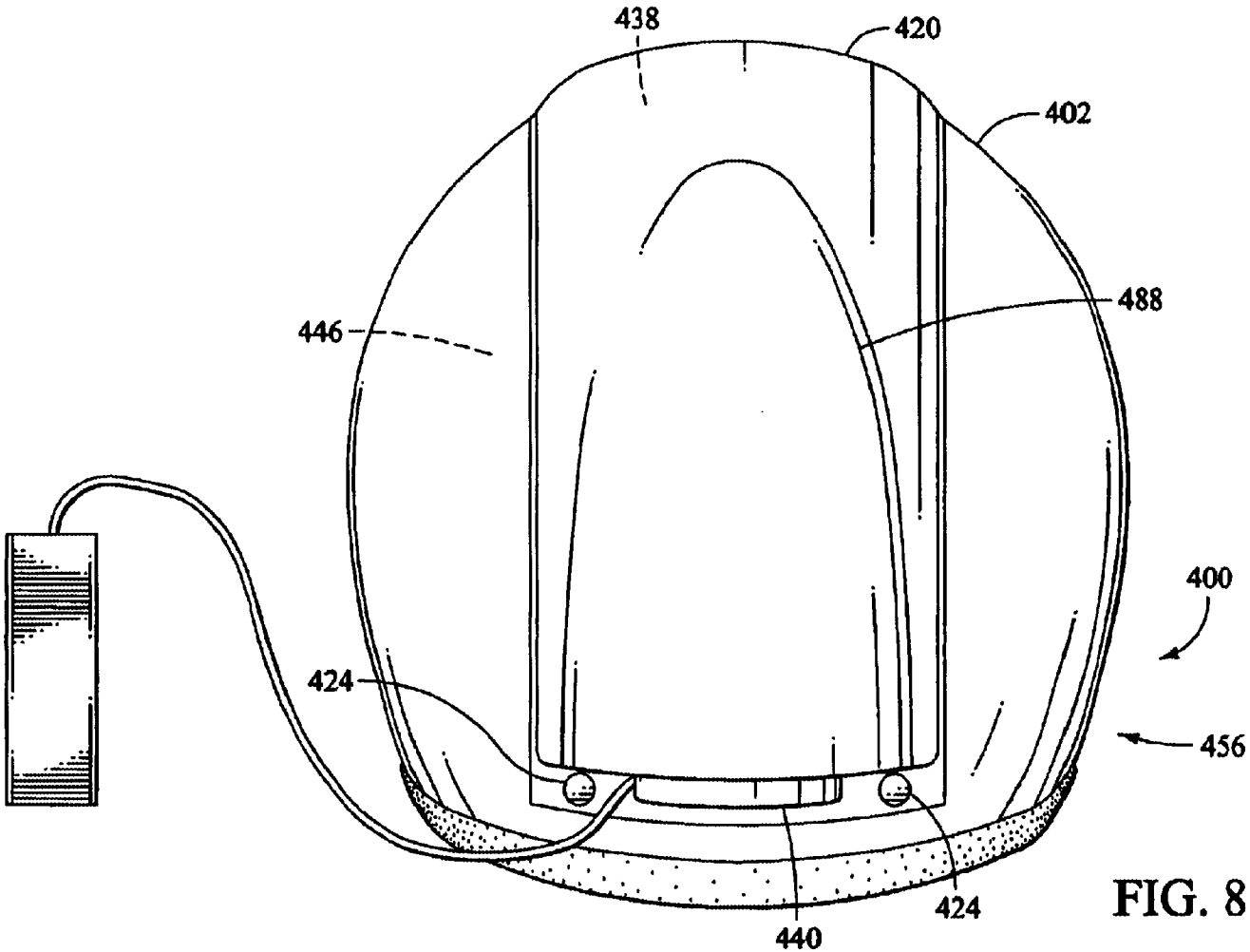
FIG. 8 is a plan view of a back side of a protective helmet in accordance with an exemplary embodiment of the present invention.

FIG. 8 is a plan view of a back side 456 of a protective helmet 400 in accordance with an exemplary embodiment of the present invention. In the embodiment of FIG. 8, a second shell piece 420 of protective helmet 400 includes a housing 488 that is dimensioned to receive a blower 440. Second shell piece 420 and a first shell piece 402 define a flow channel 438. Blower 440 may be arranged to urge a stream of air through flow channel 438 and into a head space 446 of helmet 400.

A plurality of fasteners 424 are visible in FIG. 8. Fasteners 424 may be utilized to selectively attach second shell piece 420 to first shell piece 402. In some advantageous embodiments of the present invention, blower 440 is fixed to second shell piece 420, and blower 440 is free from attachment to first shell piece 402. In these advantageous embodiments, blower 440 separates from first shell piece 402 when second shell piece 420 is separated from first shell piece 402.

Figure 9:
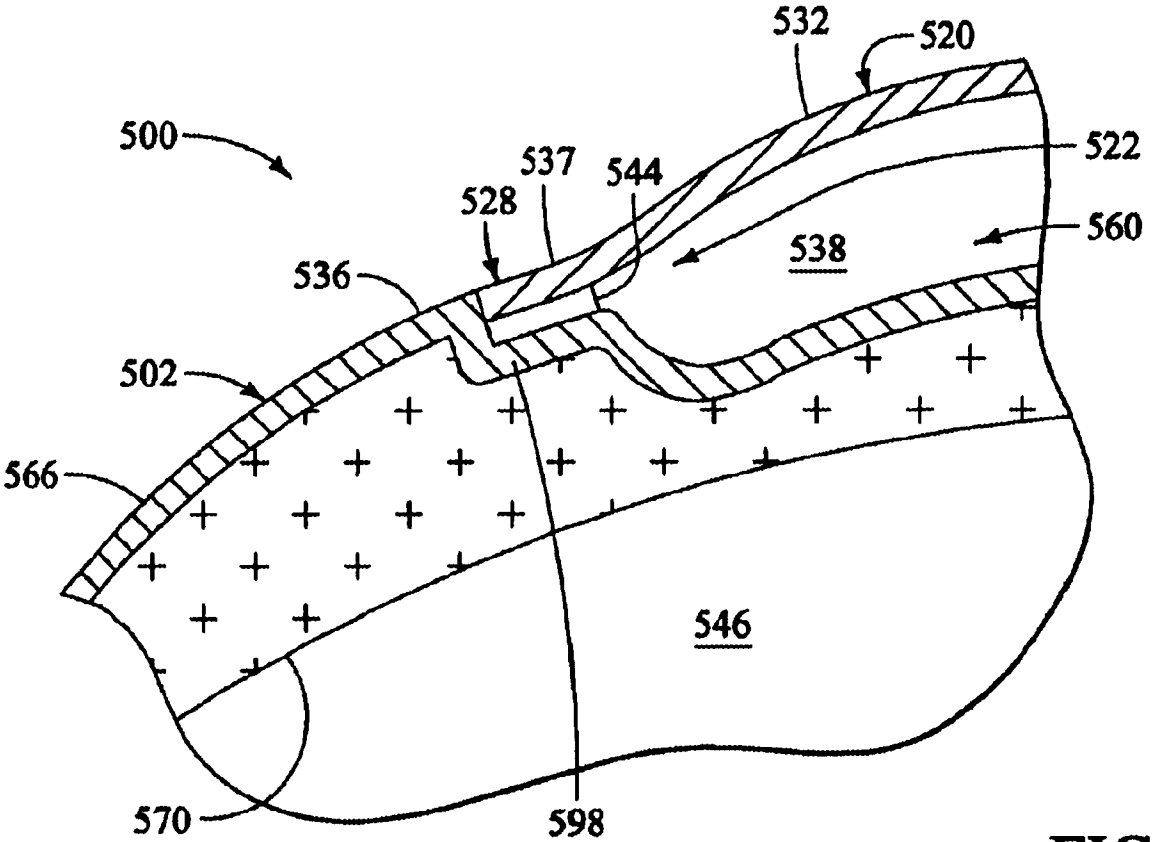
FIG. 9 is a partial cross sectional view of a helmet in accordance with an exemplary embodiment of the present invention.

FIG. 9 is a partial cross sectional view of a helmet 500 in accordance with an exemplary embodiment of the present invention. Helmet 500 includes a first shell piece 502 comprising an outer shell 566 and an inner shell 570. In FIG. 9, it may be appreciated that first shell piece 502 defines a head space 546. In the embodiment of FIG. 9, first shell piece 502 defines a trough 560 that is dimensioned to receive a second shell piece 520. In FIG. 9 it may be appreciated that second shell piece 520 and first shell piece 502 define a flow channel 538.

In FIG. 9 it may be appreciated that second shell piece 520 is attached to first shell piece 502 at an interface 522. In the embodiment of FIG. 9, interface 522 comprises a strip 544 that is disposed between first shell piece 502 and second shell piece 520. In some advantageous embodiments of the present invention, strip 544 provides a water tight seal between first shell piece 502 and second shell piece 520. Strip 544 may comprise various elements without deviating from the spirit and scope of the present invention. Examples of elements that suitable in some applications include a gasket, a bead of adhesive material, double sided foam tape, hook and loop fastener strips, and the like.

A first edge flange 528 and an intermediate portion 532 of second shell piece 520 are visible in FIG. 9. Second shell piece 520 of helmet 500 may comprise a first edge flange, a second edge flange, and an intermediate portion 532 extending between the first edge flange and the second edge flange. In the embodiment of FIG. 9, intermediate portion 532 of second shell piece 520 has a curved shape in lateral cross-section.

In the embodiment of FIG. 9, trough 560 includes a shoulder 598 that is dimensioned such that first edge flange 528 of the second shell piece 520 rests on shoulder 598 of trough 560 while second shell piece 520 is attached to first shell piece 502. In FIG. 9, it may be appreciated that shoulder 598 of trough 560 is located at a depth corresponding to a thickness of first edge flange 528 of second shell piece 520. Accordingly, an outer surface 537 of first edge flange 528 is substantially flush with an outer surface 536 of first shell piece 502 in the embodiment of FIG. 9.

In certain advantageous embodiments of the present invention, interface 522 has a pre-selected separation force. When this is the case, first shell piece 502 and second shell piece 520 will separate if the force applied across interface 522 exceeds a pre-selected value. In some embodiments, the pre-selected separation force may be selected to reduce the likelihood that a vehicle rider will be dislodged from a vehicle by a force applied to second shell piece 520 during riding. Embodiments of the present invention are possible in which the material forming strip 544 is selected such that an adhesive joint is broken if the force applied across interface 522 exceeds the pre-selected level. Embodiments of the present invention are also possible in which strip 544 breaks if the force applied across interface 522 exceeds a pre-selected level.

Figure 10:
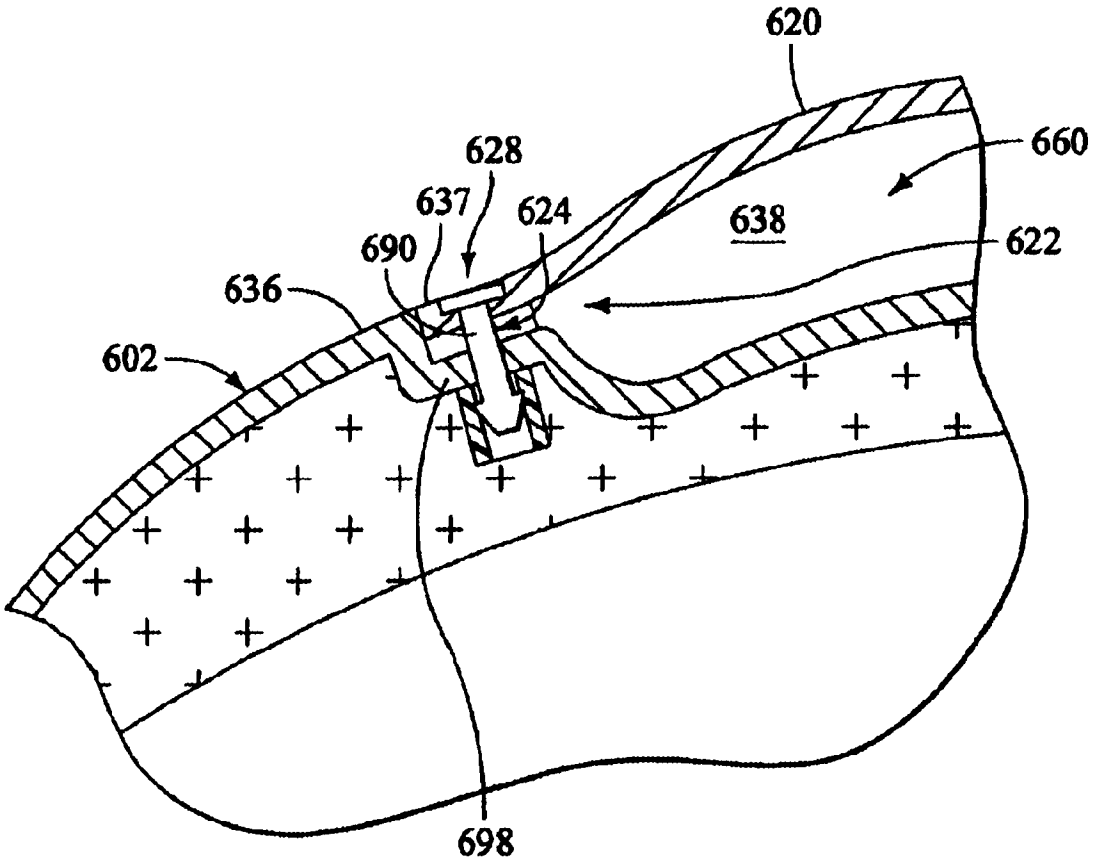
FIG. 10 is a partial cross sectional view of a helmet in accordance with an exemplary embodiment of the present invention.

FIG. 10 is a partial cross sectional view of a helmet 600 in accordance with an exemplary embodiment of the present invention. Helmet 600 of FIG. 10 includes a second shell piece 620 that is attached to a first shell piece 602 at an interface 622. In the embodiment of FIG. 10, interface 622 comprises a fastener 624. In the embodiment of FIG. 10, fastener 624 comprises a shaft 690.

In the embodiment of FIG. 10, second shell piece 620 is disposed within a trough 660 defined by first shell piece 602 so that second shell piece 620 and first shell piece 602 define a flow channel 638. In the embodiment of FIG. 10, trough 660 includes a shoulder 698 that is dimensioned such that a first edge flange 628 of the second shell piece 620 rests on shoulder 698 of trough 660 while second shell piece 620 is attached to first shell piece 602. In FIG. 10, it may be appreciated that shoulder 698 of trough 660 is located at a depth corresponding to a thickness of first edge flange 628 of second shell piece 620. Accordingly, an outer surface 637 of first edge flange 628 is substantially flush with an outer surface 636 of first shell piece 602 in the embodiment of FIG. 10.

In certain advantageous embodiments of the present invention, interface 622 has a pre-selected separation force. When this is the case, first shell piece 602 and second shell piece 620 will separate if the force applied across interface 622 exceeds a pre-selected value. In some embodiments, the pre-selected separation force may be selected to reduce the likelihood that a vehicle rider will be dislodged from a vehicle by a force applied to second shell piece 620 during riding. Embodiments of the present invention are possible in which each fastener 624 may be adapted to release at a pre-selected force. Embodiments of the present invention are also possible in which shaft 690 of fastener 624 is adapted to break when a pre-selected breaking force is applied thereto. For example, the material forming fastener 624 and the diameter of shaft 690 may be selected so that shaft 690 breaks when the pre-selected breaking force is applied to the shaft. The pre-selected breaking force may be, for example, an axial force. The pre-selected breaking force may also be, for example, a shear force.

While the invention has been described in conjunction with specific embodiments thereof, it is evident that other alternatives, modifications, and variations will be apparent to those skilled in the art in light of the foregoing description. Accordingly, it is intended to embrace all such alternatives, modifications, and variations that fall within the spirit and broad scope of the invention.

What is claimed is:

1. A protective helmet, comprising:

a first shell piece defining a head space and at least one aperture communicating with the head space;

a second shell piece detachably attached to the first shell piece at an interface;

the first shell piece and the second shell piece defining a channel in fluid communication with the at least one aperture while the second shell piece is attached to the first shell piece;

the interface having a pre-selected separation force; and a blower fluidly communicating with the channel.

2. The protective helmet of claim 1, wherein the second shell piece substantially covers the at least one aperture defined by the first shell piece while the second shell piece is attached to the first shell piece at the interface.

3. The protective helmet of claim 1, wherein the second shell piece comprises a first edge flange, a second edge flange, and an intermediate portion extending between the first edge flange and the second edge flange;

the intermediate portion having a curved shape in lateral cross-section.

4. The protective helmet of claim 1, wherein the first shell piece defines a trough that is dimensioned to receive the second shell piece.

5. The protective helmet of claim 4, wherein the trough includes a shoulder that is dimensioned such that a flange of the second shell piece rests on the shoulder of the trough while the second shell piece is attached to the first shell piece.

6. The protective helmet of claim 5, wherein the shoulder of the trough is located at a depth corresponding to a thickness of the flange of the second shell piece so that an outer surface of the flange is substantially flush with an outer surface of the first shell piece while the second shell piece is attached to the first shell piece.

7. The protective helmet of claim 1, further including a water tight seal formed between the first shell piece and the second shell piece while the second shell piece is attached to the first shell piece.

8. The protective helmet of claim 1, further including a filter disposed within the channel so that air traveling between said blower and the at least one aperture passes through the filter.

9. The protective helmet of claim 1, wherein the blower comprises an electric motor and an impeller.

10. The protective helmet of claim 9, further including at least one battery electrically connected to an electric motor of the blower.

11. The protective helmet of claim 1, wherein the blower provides an air flow through the head space which is sufficient to substantially preclude particulate entry into the head space.

12. The protective helmet of claim 1, wherein the blower provides an air flow through the head space which is sufficient to provide a positive pressure inside the head space.

13. The protective helmet of claim 12, wherein the air flow through the head space is sufficient to provide a positive pressure inside the head space while a riders head is disposed within the head space.

14. The protective helmet of claim 12, wherein the positive pressure is greater than an ambient pressure found outside the first shell piece.

15. The protective helmet of claim 8, wherein the blower is attached to the second shell piece; and the blower is free from attachment to the first shell piece so that the blower separates from the first shell piece while the second shell piece is separated from the first shell piece.

16. The protective helmet of claim 1, wherein the at least one aperture has a maximum span of less than about 13.0 millimeters.

17. The protective helmet of claim 1, further including a blower disposed proximate a bottom edge of the first shell piece.

18. The protective helmet of claim 1, further including said blower disposed proximate a back side of the first shell piece.

19. The protective helmet of claim 1, wherein the pre-selected separation force of the interface is selected so that the second shell piece separates from the first shell piece when a pre-selected force is applied across the interface.

20. The protective helmet of claim 19, wherein the pre-selected force is less than a force required to dislodge a vehicle rider from a vehicle.

21. The protective helmet of claim 1, wherein the interface comprises a plurality of fasteners.

22. The protective helmet of claim 21, wherein each fastener comprises a shaft.

23. The protective helmet of claim 22, wherein the shaft is adapted to break when a pre-selected breaking force is applied thereto.

24. The protective helmet of claim 23, wherein the pre-selected breaking force is an axial force.

25. The protective helmet of claim 24, wherein the pre-selected breaking force is a shear force.

26. The protective helmet of claim 23, wherein a diameter of the shaft is dimensioned so that the shaft breaks when the pre-selected breaking force is applied to the shaft.

27. A protective helmet, comprising:

a first shell piece defining a head space and at least one aperture communicating with the head space;

a second shell piece detachably attached to the first shell piece at an interface;

the first shell piece and the second shell piece defining a channel in fluid communication with the at least one aperture while the second shell piece is attached to the first shell piece;

the interface having a pre-selected separation force; and wherein a lateral cross sectional area of the channel gradually decreases along an air path extending from a blower to the at least one aperture.

28. The protective helmet of claim 27, wherein the second shell piece substantially covers the at least one aperture defined by the first shell piece while the second shell piece is attached to the first shell piece at the interface.

29. The protective helmet of claim 27, wherein the second shell piece comprises a first edge flange, a second edge flange, and an intermediate portion extending between the first edge flange and the second edge flange;

the intermediate portion having a curved shape in lateral cross-section.

30. The protective helmet of claim 27, wherein the first shell piece defines a trough that is dimensioned to receive the second shell piece.

31. The protective helmet of claim 30, wherein the trough includes a shoulder that is dimensioned such that a flange of the second shell piece rests on the shoulder of the trough while the second shell piece is attached to the first shell piece.

32. The protective helmet of claim 31, wherein the shoulder of the trough is located at a depth corresponding to a thickness of the flange of the second shell piece so that an outer surface of the flange is substantially flush with an outer surface of the first shell piece while the second shell piece is attached to the first shell piece.

33. The protective helmet of claim 27, further including a water tight seal formed between the first shell piece and the second shell piece while the second shell piece is attached to the first shell piece.

34. The protective helmet of claim 27, wherein the blower comprises an electric motor and an impeller.

35. The protective helmet of claim 34, further including at least one battery electrically connected to an electric motor of the blower.

36. The protective helmet of claim 27, wherein the blower provides an air flow through the head space which is sufficient to substantially preclude particulate entry into the head space.

37. The protective helmet of claim 27, wherein the blower provides an air flow through the head space which is sufficient to provide a positive pressure inside the head space.

38. The protective helmet of claim 37, wherein the air flow through the head space is sufficient to provide a positive pressure inside the head space while a riders head is disposed within the head space.

39. The protective helmet of claim 37, wherein the positive pressure is greater than an ambient pressure found outside the first shell piece.

40. The protective helmet of claim 27, wherein the blower is attached to the second shell piece; and the blower is free from attachment to the first shell piece so that the blower separates from the first shell piece while the second shell piece is separated from the first shell piece.

41. The protective helmet of claim 27, wherein the at least one aperture has a maximum span of less than about 13.0 millimeters.

42. The protective helmet of claim 27, further including a filter disposed within the channel so that air traveling between a blower and the at least one aperture passes through the filter.

43. The protective helmet of claim 27, further including said blower disposed proximate a bottom edge of the first shell piece.

44. The protective helmet of claim 27, further including said blower disposed proximate a back side of the first shell piece.

45. The protective helmet of claim 27, wherein the pre-selected separation force of the interface is selected so that the second shell piece separates from the first shell piece when a pre-selected force is applied across the interface.

46. The protective helmet of claim 45, wherein the pre-selected force is less than a force required to dislodge a vehicle rider from a vehicle.

47. The protective helmet of claim 27, wherein the interface comprises a plurality of fasteners.

48. The protective helmet of claim 47, wherein each fastener comprises a shaft.

49. The protective helmet of claim 48, wherein the shaft is adapted to break when a pre-selected breaking force is applied thereto.

50. The protective helmet of claim 49, wherein the pre-selected breaking force is an axial force.

51. The protective helmet of claim 50, wherein the pre-selected breaking force is a shear force.

52. The protective helmet of claim 49, wherein a diameter of the shaft is dimensioned so that the shaft breaks when the pre-selected breaking force is applied to the shaft.

* * * * *